US006218633B1

(12) United States Patent
Okumura et al.

(10) Patent No.: US 6,218,633 B1
(45) Date of Patent: Apr. 17, 2001

(54) SWITCH MECHANISM FOR USE IN AN ELECTRIC POWER TOOL

(75) Inventors: Michio Okumura, Okazaki; Hidenori Ito, Chiryu, both of (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 09/496,007

(22) Filed: Feb. 1, 2000

(30) Foreign Application Priority Data

Feb. 12, 1999 (JP) ..... 11-034430

(51) Int. Cl.[7] ..... H01H 9/28
(52) U.S. Cl. ..... 200/43.17; 200/321; 200/322
(58) Field of Search ..... 200/43.01, 43.11, 200/43.13, 43.16, 43.17, 43.18, 43.19, 43.21, 61.85, 522, 318, 318.1, 321, 322, 327, 332.1, 332.2

(56) References Cited

U.S. PATENT DOCUMENTS 3,550,472 * 12/1970 Dummer ..... 74/531
4,241,297 * 12/1980 Piber et al. ..... 318/17
4,348,603 * 9/1982 Huber ..... 310/50
4,998,589 * 3/1991 Wiesendanger ..... 173/170
5,414,793 * 5/1995 Morikawa ..... 388/824
5,638,945 * 6/1997 Fukinuki et al. ..... 200/43.17
6,057,518 * 5/2000 Bascom et al. ..... 200/43.17

FOREIGN PATENT DOCUMENTS 6-254779 9/1994 (JP) ..... B25F/5/00

* cited by examiner

*Primary Examiner*—Michael A. Friedhofer
(74) *Attorney, Agent, or Firm*—Foley, Hoag & Eliot LLP

(57) ABSTRACT

An electric power blower (1) includes a handle (5) mounting therein a disk-shaped speed change dial (9) which is capable of rotation on a shaft (10). The speed change dial (9) is disposed between a speed change switch (6) and a trigger switch (8) and has a cut-out (12) formed therein through which the trigger switch (8) can pass without interference, depending on the rotational position of the dial (9). The speed change dial (9) includes a stopper (13) at an free end which defines the cut-out (12). A first regulating surface (14) and a second regulating surface (15) are provided on the stopper (13), forming an angled corner therebetween. The peripheral surface of the speed change dial (9) is exposed to the outside of the blower (1) through two windows (18) in both sides of the handle (5) adjacent to the trigger switch (8) so as to allow manual rotation. The amount by which the trigger switch (8) is pulled into the handle is determined by the rotational position of the speed change dial (9).

11 Claims, 3 Drawing Sheets

SWITCH MECHANISM FOR USE IN AN ELECTRIC POWER TOOL

This application claims priority on Japanese Patent Application No. 11-34430 filed on Feb. 12, 1999, the contents of which are incorporated herein by reference.

BACKGROUND OF THE INVENTION

1. Field of the Invention

The present invention relates to switch mechanisms for use in electric power tools, such as blowers, for controlling the rotational speed of the tool motors. More particularly, the present invention relates to such a switch mechanism which includes a speed change switch having a plunger and a trigger switch for pushing in the plunger.

2. Description of the Related Art

A typical blower is provided with a switch mechanism which includes a speed change switch having a plunger and a trigger switch for pushing in the plunger. Such a speed change switch is generally accommodated in the handle of the blower. The switch mechanism regulates the rotational speed of the tool motor according to the displacement of the plunger as the trigger switch is pulled in. The Applicant disclosed in Japan Published Unexamined Patent Application No. 6-254779 one such switch mechanism which includes a trigger switch and a regulating member, such as a speed change thumb-screw, mounted on the housing of the tool. The speed change thumb-screw includes a semicircular cam eccentrically mounted on the screw's shaft. When pulled protrusions on the trigger switch are brought into contact with the cam, thus limiting the movement of the trigger switch. Since the semicircular cam of the thumb-screw is eccentrically mounted on the screw's shaft, the user of the tool can readily adjust the maximum amount by which the trigger switch is pulled in by turning the thumb-screw.

While this switch mechanism achieves its intended objective, it is not free from certain problems and inconveniences. For example, as the trigger switch is located away from the speed change thumb-screw, when the user grips the handle, for example, with his right hand and pulls the trigger switch with the index finger, no other finger of the hand reaches the thumb-screw. As the user cannot operate the two elements simultaneously with one hands the left hand is needed to adjust the speed change thumb-screw. However, as a blower is often operated by one hand to direct airflow to various objects held by the other hand, operation of this switch mechanism requires the user to interrupt the work in order to adjust the setting of the thumb-screw to change the airflow. This reduces the ease of use of the tool and affects work efficiency.

SUMMARY OF THE INVENTION

In view of the above-identified problems, an important object of the present invention is to provide a switch mechanism for an electric power tool whose trigger switch and regulating member are operable with one hand.

Another object of the present invention is to provide a switch mechanism for an electric power tool that improves the ease of use of the tool and work efficiency.

The above objects and other related objects are realized by the invention, which provides a switch mechanism for use in an electric power tool which is driven by a motor and includes a handle. The switch mechanism comprises: a speed change switch having a plunger, the speed change switch controlling the rotational speed of the motor; a trigger switch protruding out of the handle for being pulled to displace the plunger, the trigger switch displacing the plunger in correspondence with the amount by which the trigger switch is pulled; and a regulating member provided adjacent to where the trigger switch protrudes out of the handle so as to be operable from the outside of the handle. The regulating member, when operated, blocks the movement of the trigger switch as the trigger switch is pulled, thus controlling the amount by which the trigger switch is pulled. According to the foregoing switch mechanism, the regulating member can be operated to determine the amount by which the trigger switch is pulled into the handle, thus controlling the rotational speed of the motor. Moreover, as the regulating member is exposed adjacent to where the trigger switch projects out of the handle to permit operation from the outside of the handle, the user of the electric power tool can operate the trigger switch and the regulating member simultaneously with the hand holding the handle. This means the user can adjust the operation of the motor without discontinuing the work, thus enhancing the operability of the electric power tool and work efficiency.

According to one aspect of the present invention, the trigger switch, the speed change switch, and the plunger are disposed along an axis with the plunger interposed between the trigger switch and the speed change switch. In addition, when operated, the regulating member is located between the trigger switch and the speed change switch without interfering with the plunger so as to block the movement of the trigger switch.

According to another aspect of the present invention, the regulating member is a generally circular member rotatably supported by a shaft such that when the circular regulating member is rotated, a portion of the member is located between the trigger switch and the speed change switch and blocks the movement the trigger switch. The regulating member, being circular and rotatably operated on a shaft, facilitates adjustments of the rotational speed of the motor without affecting the manual operation of the trigger switch.

According to still another aspect of the present invention, the regulating member is capable of rotating between at least two positions and includes a cut-out and an arm defined by the cut-out, with the cut-out configured so as to allow the trigger switch to move through the regulating member without interference. When the regulating member is located in a first position, the arm blocks the movement of the trigger switch and when the regulating member is located in a second position, the trigger switch can be pulled through the cut-out without interference.

According to yet another aspect of the present invention, the arm is formed with a first surface located at a first predetermined distance from the trigger switch when the trigger switch is not pulled and the arm is further formed with a second surface oriented at an angle to the first surface and located at a second predetermined distance from the trigger switch when the trigger switch is not pulled. In this case, the second distance is made greater than the first distance. In addition, when the regulating member is in the first position, the first surface blocks the trigger switch as soon as the trigger switch has moved the first distance, and when the regulating member is in a third position, the second surface blocks the trigger switch as soon as the trigger switch has moved the second distance. Therefore, the movement of the trigger switch and thus the displacement of the plunger can be controlled in three different levels in this switch mechanism.

According to one feature of the present invention, the switch mechanism further comprises a rotation limiting member for allowing rotation of the regulating member within a predetermined range having two outer limits. One of the outer limits is located in the first position, whereas the other is located in the second position with the third position located intermediately between the two outer limits.

According to another feature of the present invention, the handle includes a pair of casing halves generally symmetrical about a ridge and the handle further includes two windows provided on both sides of the ridge so as to expose a peripheral surface of the circular regulating member for operation of the regulating member from the outside of the handle. As the circular regulating member is exposed to both sides of the handle for manual operation, the electric tool can be used equally well whether the user holds the handle with the right or left hand.

According to still another feature of the present invention, the regulating member includes at least two interfering surfaces for, when rotated, blocking the movement of the trigger switch to displace the plunger, with the interfering surfaces configured to block the movement of the trigger switch at two corresponding positions of the trigger switch relative to the speed change switch. Furthermore, the interfering surfaces can be moved to a third position where the trigger switch is allowed to move without interference.

According to yet another feature of the present invention, the circular regulating member is a dial plate with symbols marked on the peripheral surface thereof, with the symbols corresponding to the three different levels of the movement of the trigger switch.

According to one practice of the present invention, the switch mechanism further comprises an elastic member disposed within the handle. The regulating member includes three recesses corresponding to the three positions of the regulating member, and when the regulating member is located in one of the three positions, the corresponding recess engages the elastic member.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

DETAILED DESCRIPTION OF THE PREFERRED EMBODIMENT

A preferred embodiment according to the present invention will be described hereinafter with reference to the attached drawings.

Figure 1:
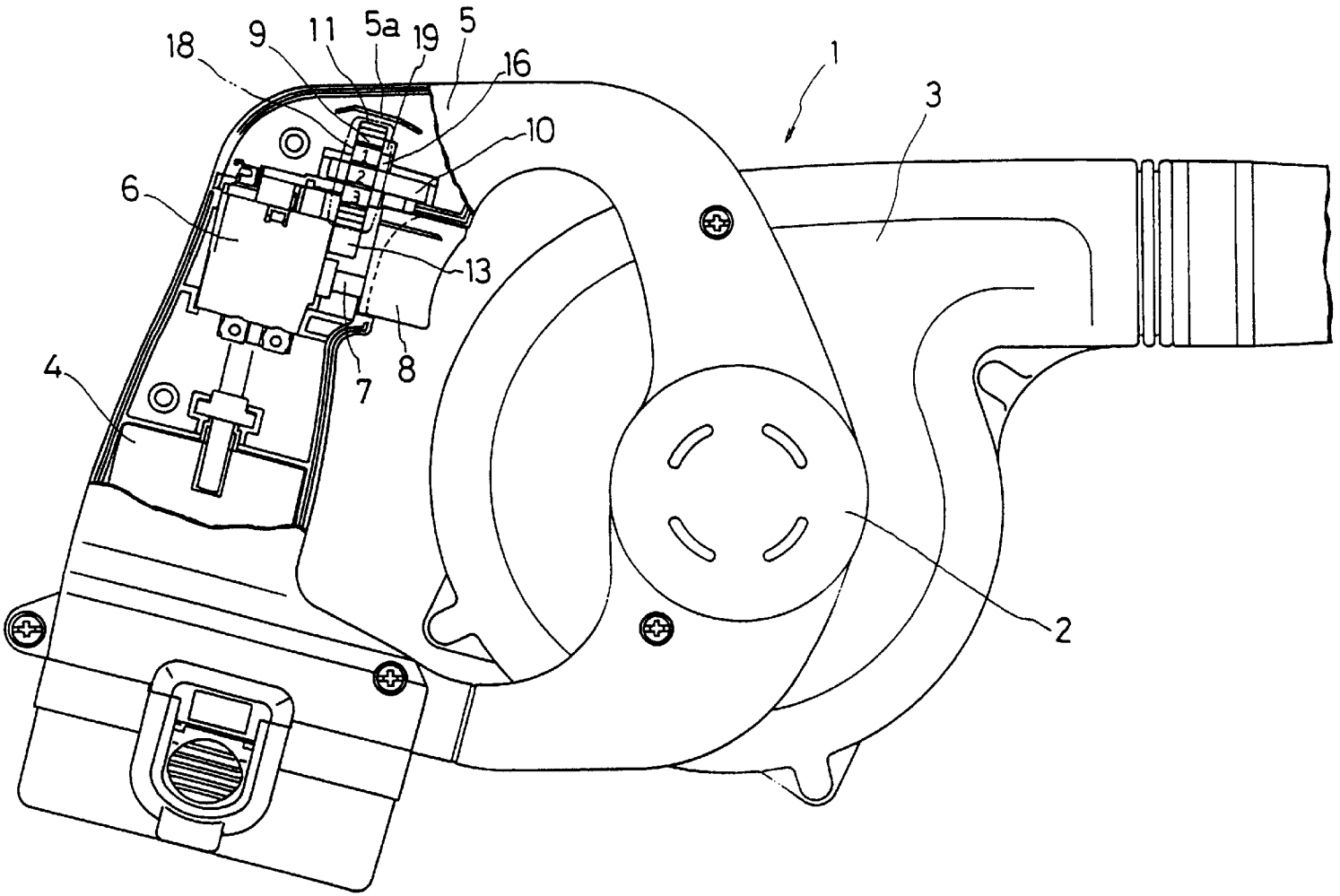
FIG. 1 is a side view of an essential part of an electric power blower 1 according to the present invention, shown with part of its casing removed to expose a mechanism for changing the speed a motor of the blower.

FIG. 1 is a side view of an essential part of an electric power blower 1 in accordance with the present invention, shown with part of its casing removed to expose the inside thereof. The blower 1 includes a motor 2, a spiral fan (not shown) driven by the motor 2, a main body 3 for discharging air drawn in by the rotation of the spiral blades, and a handle 5. In addition, a battery pack 4 is detachably accommodated inside the handle 5 to supply power to the blower 1. The handle 5 is assembled from two casing halves split along the ridge of the handle. A speed change switch 6 for changing the rotational speed of the motor 2 is disposed at the rear (to the left of the drawing) of the handle 5. The speed change switch 6 includes a plunger 7 biased in the direction in which the plunger projects out of the switch 6. A trigger switch 8 is connected to the top end of the plunger 7 and projects out of the handle 5. The operator of the blower 1 can adjust the rotational speed of the motor 2 and thus the airflow generated by the motor by controlling the displacement of the plunger, which corresponds to the amount by which the trigger switch is pulled.

As shown in FIGS. 1 and 2A to 2F, a regulating member, such as a speed change dial 9, is mounted above the speed change switch 6 and the trigger switch 8. The speed change dial 9 is a generally circular plate member which includes a flat surface 11 at its top and is mounted around a shaft 10 extending in parallel to the direction in which the plunger 7 projects. The speed change dial 9 is capable of rotating clockwise and counterclockwise about the shaft 10 within the range limited by its abutment against a rib 5*a* provided on the inner surface of the handle 5. The rib 5*a* is provided for routing the wires and cords within the handle 5. The lower part of the speed change dial 9 below the shaft 10 is located between the speed change switch 6 and the trigger switch 8. Additionally, a cut-out 12 is formed in the lower part of the speed change dial 9 so as to allow the trigger switch 8 to be pulled through the cut-out without interfering with the dial 9, depending on the rotational position of the dial 9.

A stopper 13 is formed at the free end of one of the two arms defining the cut-out 12 in order to regulate the degree to which the trigger switch 8 is manually pulled into the handle 5. The stopper 13 includes a first regulating surface 14 and a second regulating surface 15 which form an angled comer therebetween. The first surface 14 is located closer to the speed change switch 6 than the second surface 15. Rotation of the speed change dial 9 changes the positions of the first regulating surface 14 and the second regulating surface 15 relative to the trigger switch 8.

In this embodiment, the circumferential surface of the speed change dial 9 is exposed through two identical windows 18 each provided in one casing half of the handle 5. Additionally, the windows 18 are positioned adjacent to where the trigger switch 8 projects out of the handle 5 so as to allow the speed change dial 9 to be operated from either side of the handle 5. In addition, the peripheral surface of the speed change dial 9 is marked with two sets of numerals 1–3 that correspond to the three switch positions available for the speed change dial 9 (to be discussed in further detail below).

Figure 4:
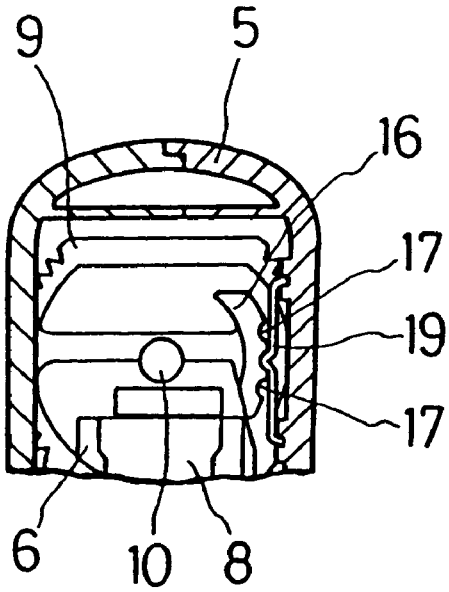
FIG. 4 is another cross section of the blower of FIG. 1, showing the speed change dial and an associated click mechanism.

As best shown in FIG. 4 (but visible throughout the drawings), a leaf spring 19 is secured inside the handle 5 at the right (as seen in FIGS. 2A–2F) window 18. Additionally, the speed change dial 9 includes on the front side thereof a click plate 16 formed with three recesses 17 for engaging the leaf spring 19. As the speed change dial 9 is rotated, the leaf spring 19 selectively clicks in and engages one of the recesses 17 according to the switch position of the speed change dial 9, thus securing the dial 9 at the desired position.

Figure 2A:
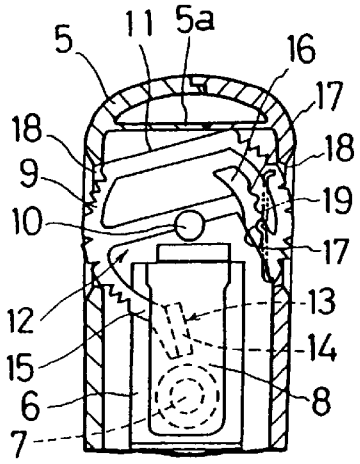
FIG. 2A–2B shows the speed change mechanism shown in FIG. 1 when the mechanism is rotated to a minimum speed position.
Figure 2B:
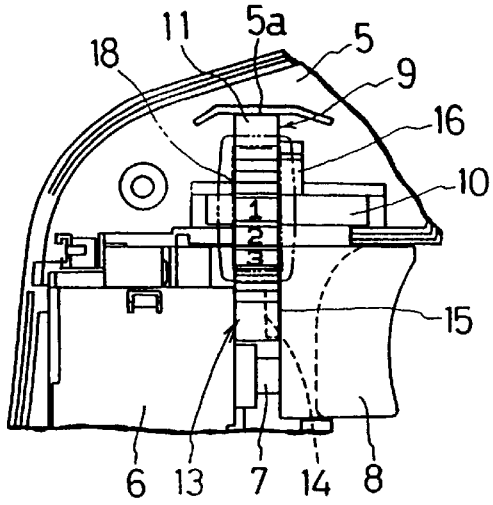

In the operation of the electric power blower 1 thus constructed, when the speed change dial 9 is rotated to the position shown in FIG. 2A–2B, the right edge of the flat surface 11 of the speed change dial 9 abuts the rib 5*a*. In this position, a large portion of the stopper 13 is located in the space between the speed change switch 6 and the trigger switch 8 such that the second regulating surface 15 is located directly behind the trigger switch 8. When pulled, the trigger switch 8 is allowed to travel a minimum distance before coming into abutment with the second regulating surface 15, causing the motor 2 to operate at a minimum speed (or to generate a minimum airflow).

Figure 2C:
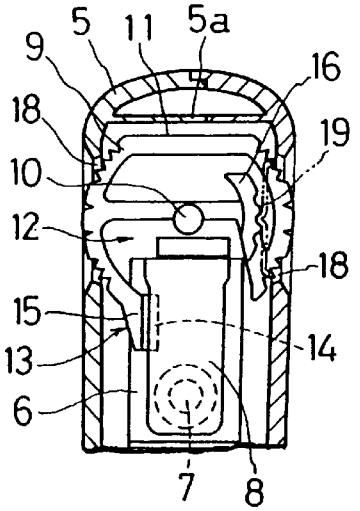
FIG. 2C–2D shows the speed change mechanism shown in FIG. 1 when the mechanism is rotated to a medium speed position.
Figure 2D:
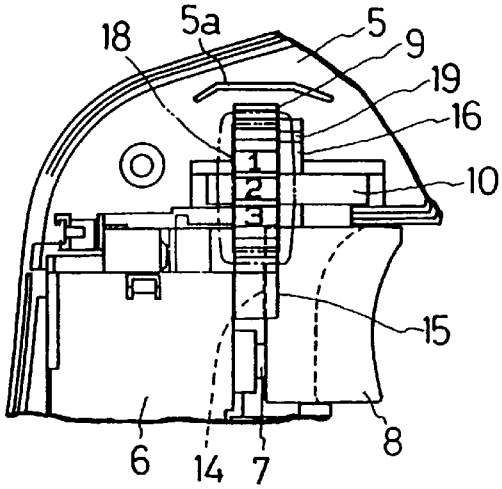

When the speed change dial 9 is clicked from the low speed position into the next position, where the surface 11 of the speed change dial 9 lies horizontal to the rib 5*a* as shown in FIG. 2C–2D, the stopper 13 is rotated outward to locate only the first regulating surface 14 directly behind the trigger switch 8. When pulled, the trigger switch 8 is allowed to travel a longer distance before coming into abutment with the second regulating surface 15 than in the position shown in FIG. 2A–2B, causing the motor 2 to operate at a medium speed (or to generate a medium airflow).

Figure 2E:
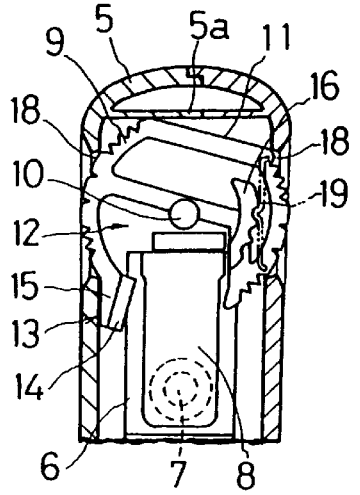
FIG. 2E–2F shows the speed change mechanism shown in FIG. 1 when the mechanism is rotated to a maximum speed position.
Figure 2F:
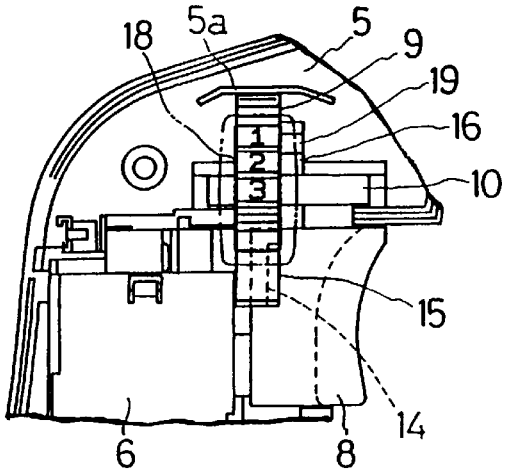
Figure 3:
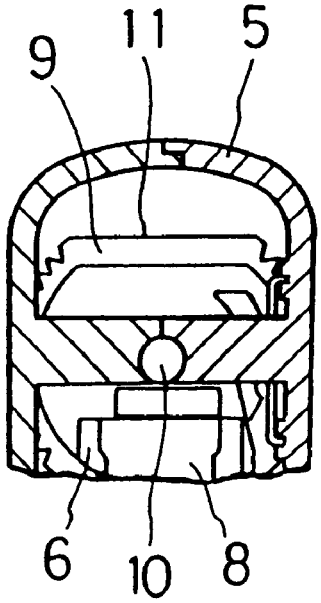
FIG. 3 is a cross section of the blower of FIG. 1, showing the blower's speed change dial supported by a shaft.

As shown in FIG. 2E–2F, when the speed change dial 9 is clicked from the medium speed position to the next position, the left edge of the flat surface 11 of the speed change dial 9 abuts the rib 5*a*. In this position, the stopper 13 is completely cleared of the path of the trigger switch 8, thus allowing unobstructed movement of the trigger switch 8 through the cut-out 12. Accordingly, when pulled, the trigger switch 8 is allowed to travel an even longer distance than in the position shown in FIG. 2C–2D, causing the motor 2 to operate at a maximum speed (or to generate a maximum airflow).

According to the foregoing embodiment, therefore, the positions of the first regulating surface 14 and the second regulating surface 15 of the stopper 13 can be changed by rotating the speed change dial 9 so as to determine the amount by which the trigger switch 8 is pulled into the handle 5. This in turn determines the amount of airflow generated by the motor 2 and the spiral fan. Moreover, as the speed change dial 9 is exposed adjacent to where the trigger switch 8 projects out of the handle 5 so as to permit manual operation through the windows 18 from the outside of the handle 5, the user of the blower 1 can operate the trigger switch 8 and the speed change dial 9 simultaneously with the hand holding the handle 5. This means the user can change the airflow without discontinuing the work, thus enhancing the operability of the blower 1 and work efficiency.

Furthermore, the disk-shaped speed change dial 9, as it is exposed to both sides of the handle 5, facilitates adjustments of the airflow without affecting the manual operation of the trigger switch 8. Another advantage of this arrangement is that due to its symmetry, the blower 1 can be used equally well whether the user hold the handle 5 with the right or left hand.

The number of regulating surfaces can be changed depending on the application and should be determined by the number of airflow levels required. Instead of two windows 18, as in the embodiment, only one window may be provided in the handle 5 if such arrangement allows the operator to easily turn the speed change dial 9 with the hand gripping the handle 5.

In the foregoing embodiment, an arm-shaped stopper on a disk-shaped speed change dial 9 is rotated into the space between the speed change switch 6 and the trigger switch 8 by rotation of the dial 9. However, any other suitable element, such as a slider with regulating surfaces, can be used to achieve the same objective. Such a slider may be mounted in the handle of the blower so as to be exposed for manual slide orthogonal to the direction in which the trigger switch 8 is pulled. If the regulating surfaces of the slider are configured to interfere with the trigger switch 8 in different slide positions of the slider, the displacement of the trigger switch 8 can be controlled, thus producing a similar or identical effect as in the embodiment.

Furthermore, although in the foregoing embodiment, the trigger switch 8 is integrally coupled to the plunger 7 of the speed change switch 6, the trigger switch and the plunger can be separately provided. In addition, the present invention is equally applicable to a trigger switch with one end thereof supported on a pin or similar element. The present invention is also applicable to other types of electric power tools than blowers, including reciprocating saws, as long as such tools include speed change switches.

It will thus be seen that the present invention efficiently attains the objects set forth above among those made apparent from the preceding description. As other elements may be modified, altered, and changed without departing from the scope or spirit of the essential characteristics of the present invention, it is to be understood that the above embodiments arc only an illustration and not restrictive in any sense. The scope or spirit of the present invention is limited only by the terms of the appended claims.

What is claimed is:

1. A switch mechanism for use in an electric power tool which is driven by a motor and includes a handle, the mechanism comprising:

a speed change switch having a plunger, the speed change switch controlling the rotational speed of the motor;

a trigger switch protruding out of the handle for being pulled to displace the plunger, the trigger switch displacing the plunger in correspondence with an amount by which the trigger switch is pulled; and a regulating member provided adjacent to where the trigger switch protrudes out of the handle so as to be operable from outside of the handle, the trigger switch, the speed change switch, and the plunger being disposed along an axis with the plunger interposed between the trigger switch and the speed change switch, the regulating member, when operated, being located between the trigger switch and the speed change switch, without interfering with the plunger, so as to block the movement of the trigger switch as the trigger switch is pulled, thus controlling the amount by which the trigger switch is pulled.

2. A switch mechanism in accordance with claim 1, wherein the regulating member is a generally circular member rotatably supported by a shaft such that when the circular regulating member is rotated, a portion of the member is located between the trigger switch and the speed change switch and blocks the movement of the trigger switch.

3. A switch mechanism in accordance with claim 2, wherein the regulating member is capable of rotating between at least two positions and includes a cut-out and an arm defined by the cut-out, the cut-out being configured so as to allow the trigger switch to move through the regulating member without interference, and wherein when the regulating member is located in a first position, the arm blocks the movement of the trigger switch and when the regulating member is located in a second position, the trigger switch can be pulled through the cut-out without interference.

4. A switch mechanism in accordance with claim 3, wherein the arm is formed with a first surface located at a first predetermined distance from the trigger switch when the trigger switch is not pulled and the arm is further formed with a second surface oriented at an angle to the first surface and located at a second predetermined distance from the trigger switch when the trigger switch is not pulled, the second distance being greater than the first distance, and further wherein when the regulating member is in the first position, the first surface blocks the trigger switch as soon as the trigger switch has moved the first distance, and when the regulating member is in a third position, the second surface blocks the trigger switch as soon as the trigger switch has moved the second distance, thereby controlling the movement of the trigger switch and thus the displacement of the plunger in three different levels.

5. A switch mechanism in accordance with claim 4 further comprising a rotation limiting member for allowing rotation of the regulating member within a predetermined range having two outer limits, one of the outer limits being located in the first position and the other being located in the second position with the third position located intermediately between the two outer limits.

6. A switch mechanism in accordance with claim 4, wherein the circular regulating member is a dial plate with symbols marked on the peripheral surface thereof, the symbols corresponding to the three different levels of the movement of the trigger switch.

7. A switch mechanism in accordance with claim 4 further comprising an elastic member disposed within the handle, and wherein the regulating member includes three recesses corresponding to the three positions of the regulating member, and wherein when the regulating member is located in one of the three positions, the corresponding recess engages the elastic member.

8. A switch mechanism in accordance with claim 2, wherein the regulating member includes at least two interfering surfaces for when rotated, blocking the movement of the trigger switch to displace the plunger, the interfering surfaces being configured to block the movement of the trigger switch at two corresponding positions of the trigger switch relative to the speed change switch, and wherein the interfering surfaces can be moved to a third position where the trigger switch is allowed to move without interference.

9. A switch mechanism in accordance with claim 8, wherein the handle includes a pair of casing halves generally symmetrical about a ridge and the handle further includes two windows provided on both sides of the ridge so as to expose a peripheral surface of the circular regulating member for operation of the regulating member from the outside of the handle.

10. A switch mechanism in accordance with claim 1, wherein the handle includes a pair of casing halves generally symmetrical about a ridge and the handle further includes two windows provided on both sides of the ridge so as to expose a peripheral surface of the circular regulating member for operation of the regulating member from the outside of the handle.

11. A switch mechanism for use in an electric power tool which is driven by a motor and includes a handle, the mechanism comprising:

a speed change switch having a plunger, the speed change switch controlling the rotational speed of the motor;

a trigger switch protruding out of the handle for being pulled to displace the plunger, the trigger switch displacing the plunger in correspondence with an amount by which the trigger switch is pulled; and a generally circular regulating member provided adjacent to where the trigger switch protrudes out of the handle so as to be operable from outside of the handle, the generally circular regulating member being rotatably supported by a shaft such that rotation of the generally circular regulating member positions a portion of the member between the trigger switch and the speed change switch to block the movement of the trigger switch as the trigger switch is pulled, thus controlling the amount by which the trigger switch is pulled.

* * * * *

UNITED STATES PATENT AND TRADEMARK OFFICE

CERTIFICATE OF CORRECTION

PATENT NO. : 6,218,633 B1
DATED : April 17, 2001
INVENTOR(S) : Michio Okumura and Hidenoru Ito It is certified that error appears in the above-identified patent and that said Letters Patent is hereby corrected as shown below:

Column 4,
Line 44, replace "comer" with -- corner --.

Column 6,
Line 25, replace "arc" with -- are --.

Signed and Sealed this

Nineteenth Day of March, 2002

*Attest:*

*Attesting Officer*

JAMES E. ROGAN
*Director of the United States Patent and Trademark Office*